United States Patent [19]

Lutz

[11] 4,307,520

[45] Dec. 29, 1981

[54] LIFTER FOR DRIER DRUM

[75] Inventor: David L. Lutz, Loomis, Calif.

[73] Assignee: Kenco Engineering, Inc., Roseville, Calif.

[21] Appl. No.: 161,202

[22] Filed: Jun. 19, 1980

[51] Int. Cl.[3] ..... F26B 11/04

[52] U.S. Cl. ..... 34/108; 34/135; 34/142; 34/243 R; 366/25; 366/228; 432/118

[58] Field of Search ..... 432/110, 118; 366/22, 366/25, 54, 55, 220, 228; 34/52, 108, 109, 134, 135, 136, 137, 142, 243 R

[56] References Cited

U.S. PATENT DOCUMENTS

| | | | |
|---|---|---|---|
| 3,025,611 | 3/1962 | Preeman | 34/109 |
| 3,296,711 | 1/1967 | Langford et al. | 34/109 |
| 3,814,588 | 6/1974 | Eweson et al. | 34/138 |
| 4,181,495 | 1/1980 | Bernt | 432/118 |

*Primary Examiner*—Larry I. Schwartz

*Attorney, Agent, or Firm*—Jack M. Wiseman; Francis W. Anderson

[57] ABSTRACT

Bucket-type material lifters are adjustably mounted on the inner peripheral surface of a drier drum between pairs of spaced plates carried by the drum, so that the position at which each lifter starts to discharge material during rotation of the drum and the position at which it completes its discharge can be selectively changed.

8 Claims, 14 Drawing Figures

FIGURE 1
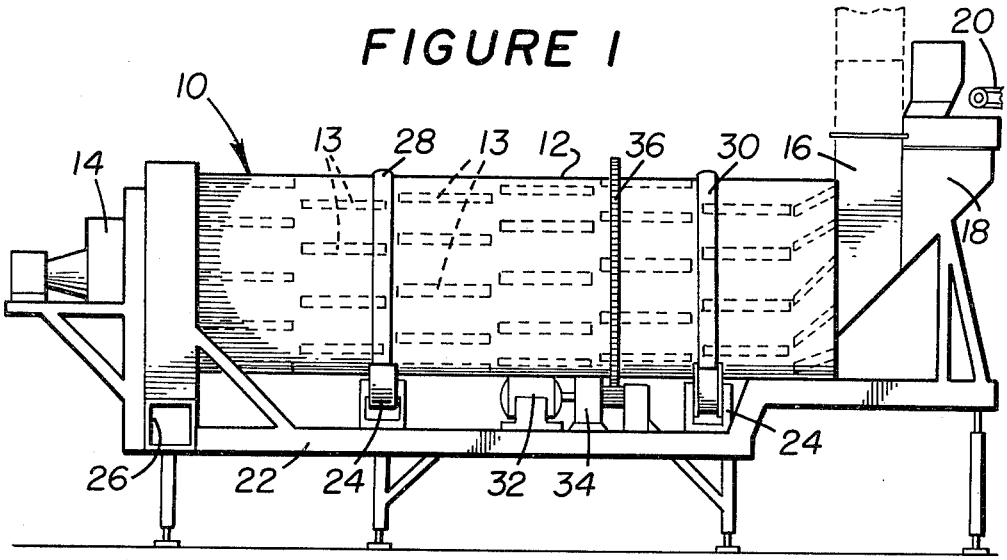
FIGURE 2
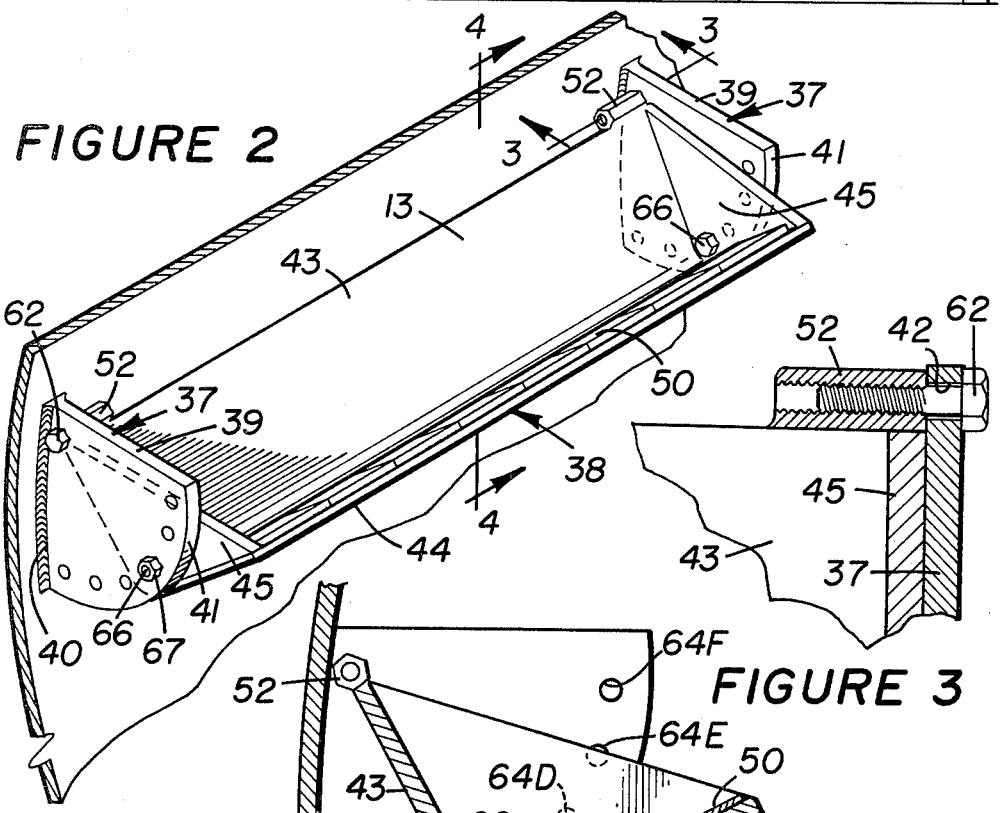
FIGURE 3
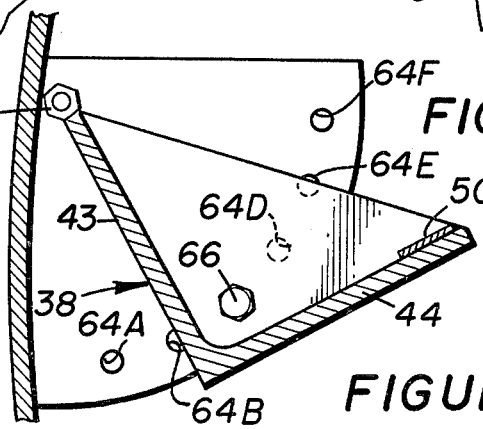
FIGURE 4

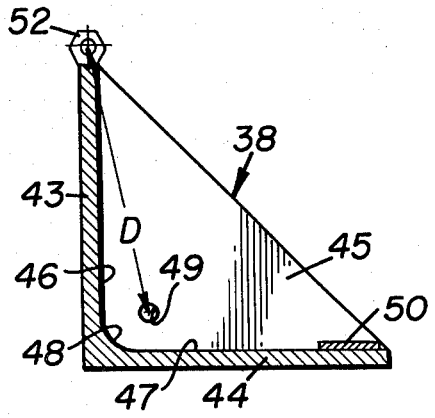
FIGURE 5
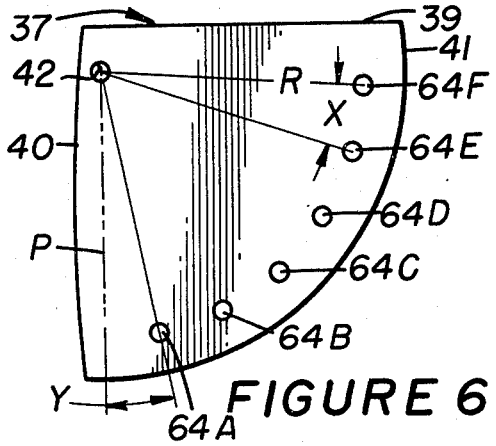
FIGURE 6
FIGURE 7
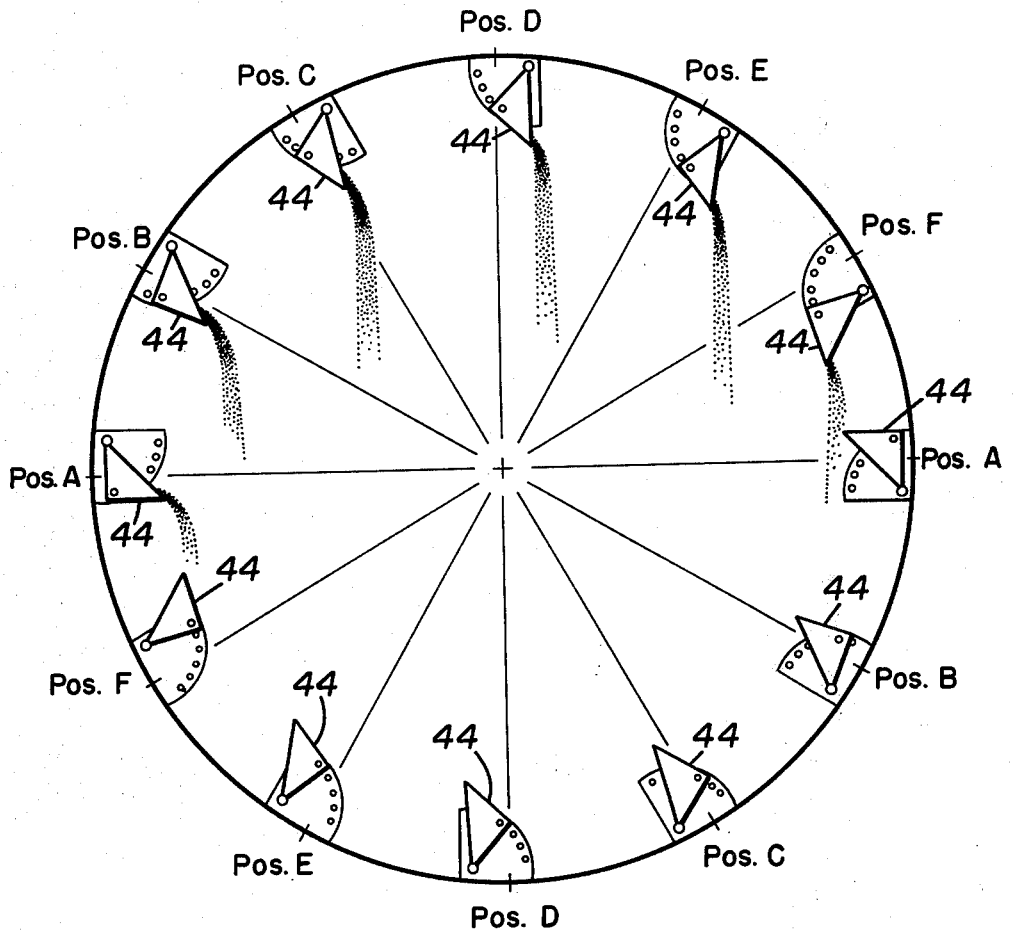

FIGURE 8
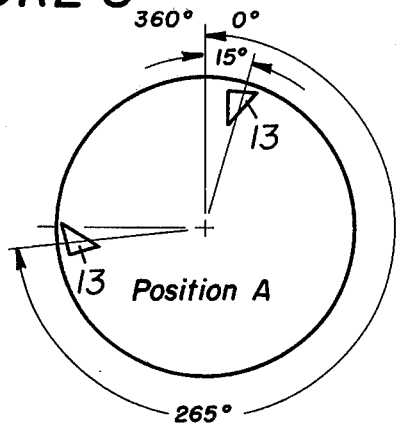
FIGURE 9
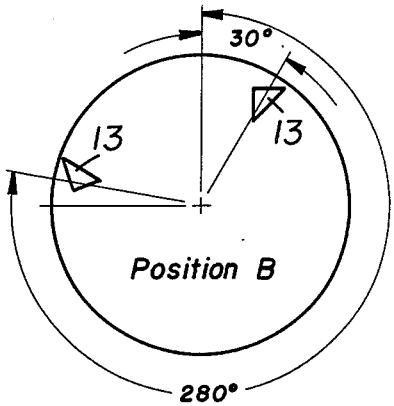
FIGURE 10
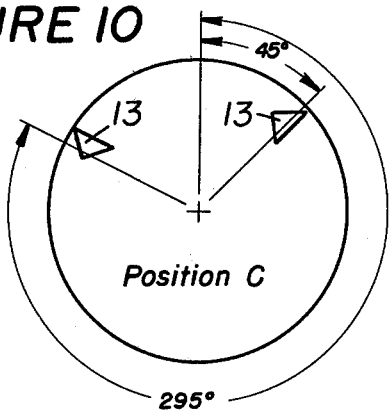
FIGURE 11
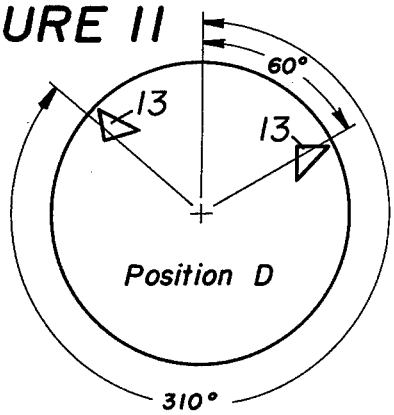
FIGURE 12
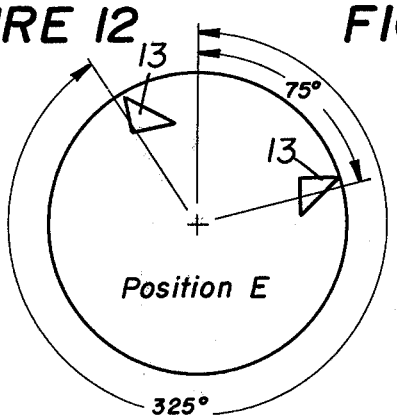
FIGURE 13
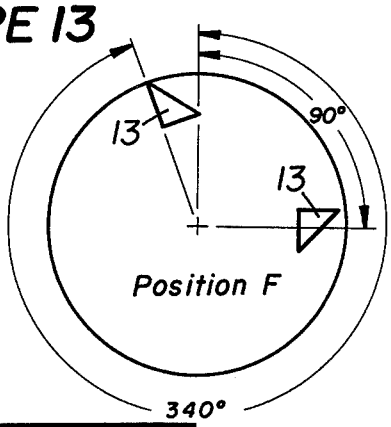
FIGURE 14
| POS. | BEGIN DUMPING WHEN 27° | EMPTY WHEN VERTICAL |
|---|---|---|
| A | 265° | 15° |
| B | 280° | 30° |
| C | 295° | 45° |
| D | 310° | 60° |
| E | 325° | 75° |
| F | 340° | 90° |

LIFTER FOR DRIER DRUM

BACKGROUND OF THE INVENTION

1. Field of the Invention.

This invention relates to drum-type driers and more particularly concerns improved bucket-type lifters for drier drums.

2. Description of the Prior Art.

In a conventional type of drier drum, the lifter buckets are mounted on the inner peripheral wall of the drum in a particular fixed position such that, when a material having average characteristics of density, wetness, flowability and the like is passed through the drum, it will be adequately dried as it is lifted up and dropped downwardly through the heated gases in the drum. However, it will be appreciated that when the buckets are set to form an effective curtain of downwardly moving material having average characteristics, they will not necessarily operate effectively on materials having other characteristics since different materials require different amounts of exposure to the flames and gases passing longitudinally in the drum.

SUMMARY OF THE INVENTION

Lifter buckets are mounted on the inner peripheral surface of a drier drum between pairs of fixed mounting plates. Each bucket is pivotally mounted between a pair of mounting plates and each end wall of the bucket has a hole therethrough at a point spaced from the pivot axis of the bucket. Each of the two mounting plates has a plurality of spaced holes located on an arc of a circle having the pivot axis as its center. To give the bucket a desired operation orientation relative to the drum, it is pivoted to a position corresponding to that orientation, bringing the holes in the end walls of the bucket into registry with a selected pair of holes in the plates. While the bucket is held in this position, bolts are inserted through the aligned holes to lock the bucket in that position.

DESCRIPTION OF THE DRAWINGS

FIG. 1 is a schematic side elevation of one form of the drier drum in which the lifters of the present invention may be used.

FIG. 2 is an isometric showing of a bucket constructed according to the present invention, a portion of the inner wall of the drum being shown.

FIG. 3 is a fragmentary section taken along line 3—3 of FIG. 2.

FIG. 4 is a section taken on line 4—4 of FIG. 2.

FIG. 5 is a section similar to FIG. 3 but showing only the bucket.

FIG. 6 is an elevation of one of the mounting plates on which the bucket is mounted.

FIG. 7 is a diagrammatic vertical transverse section through a drier drum, showing selected adjusted positions of various lifter buckets.

FIGS. 8–13 are reduced diagrammatic vertical transverse sections through a drier drum, each view showing the beginning and termination of the dumping action of a bucket which has been mounted in one of the positions shown in FIG. 7.

FIG. 14 is a chart on which the dumping characteristics of buckets in each of the positions illustrated in FIG. 7 are listed.

DESCRIPTION OF A PREFERRED EMBODIMENT

In FIG. 1 the reference numeral 10 indicates generally a drier of the type employed to dry aggregate alone or to dry aggregate as it is being mixed with asphalt in a rotating drum 12. In the latter case, a drum equipped with the lifters of the present invention will not only dry the material but will also thoroughly mix it, thus making a separate mixer unnecessary. A plurality of lifters or buckets 13 are mounted in spaced relation on the interior wall of the drum and are effective, during rotation of the drum, to pick up the material in the lower portion of the drum's interior, raise it to an elevated position and discharge it so that it falls as a curtain of aggregate and asphalt through flames and hot gases that are passing through the drum. These gases are generated by a burner 14 which projects into one end of the drum, and they are moved through the drum by a blower associated with the burner. As the hot gases move from left to right (FIG. 1), they pass through the curtain of aggregate and asphalt mix, remove moisture from the mix, and leave the drum through a stack 16.

The aggregate, which travels from right to left while it is being tumbled in the drum, is directed into the drum at the right hand end thereof by an inclined chute 18 which receives the aggregate from a supply conveyor 20. The drum is mounted on a support structure 22 on trunnions 24 in a slightly inclined position so that the material in the drum will gradually move from right to left and be discharged through a discharge opening 26. The drum, which has support rings 28 and 30 in contact with the trunnion rollers, is rotated by a motor 32 through a geared speed reducer 34 that drives a sprocket ring 36 fixed to the drum. The asphalt is injected into the aggregate at a point intermediate the length of the drum by conventional asphalt-handling injectors.

As mentioned above, an asphalt mix may consist of various ingredients, and the consistency and flowability of different mixes vary. A feature of this invention is the adjustable mounting of the lifters on the interior wall of the drum whereby the point in the drum at which the mix is released from the lifters to drop downwardly through the hot gases can be changed in accordance with the composition of the mix. Each lifter comprises two spaced mounting plates 37 (FIG. 2) with a scoop member 38 mounted therebetween. The two plates 37, which are identical and are made of steel, are of generally triangular configuration in side elevation having a flat upper surface 39, an inner surface 40 formed on a radius equal to the radius of the inner surface of the cylindrical drum of the drier, and an outer surface 41 which is formed on a radius from the center of an aperture 42 (FIG. 6) which extends through each plate near the junction of surfaces 39 and 40. The two plates of each lifter are welded to the inner surface of the drum, as seen in FIG. 2, in alignment with each other longitudinally of the drum and with the arcuate surfaces 40 in abutting contact with the inner surface of the drum.

The scoop 38, which is also made of steel, is an elongate member comprising a back wall 43, a bottom wall 44 extending at right angles to the back wall, and a generally triangular end wall 45 at each end. Each end wall is a rigid plate member having straight side edges 46 and 47 that abut the inner surfaces of 43 and 44 respectively and a curved edge 48 which fits snugly in a concave corner provided by the walls 43 and 44. A hole 49 is formed in each end wall near the curved corner 48. The four walls of the scoop are welded together to form a unitary structure.

A steel wear plate 50, which has been heat treated to a 62 Rockwell C hardness, is secured to the wall 44 near its outer edge to resist the abrading action of the aggregate on the inner surface of that wall. The wear plate may be made up of a plurality of short strips of steel mounted in alignment near the outer edge of the wall 44 to form a continuous wear plate.

As seen in FIGS. 2, 3 and 4, a tubular connector 52 is welded to the upper edge of the back wall 43 at each end of the wall. The connector has a threaded interior opening and an outer surface that is hexagonal in cross-section and, when it is in welded position on the edge of the wall, one flat area of its exterior surface is in flat contact with the upper edge of the wall so that the longitudinal axis of the threaded central openings of the two connectors are in alignment longitudinally of the lifter. It should be noted in FIG. 5 that the center of the hole 49 is located a predetermined distance D from the axis of the adjacent connector.

The scoop is pivotally mounted between the two mounting plates by two bolts 62 (FIG. 3) each of which extends through the opening 42 in one of the mounting plates and is threaded into the adjacent connector 52.

A feature of the present invention is the ability to change the angular position of each scoop 38 relative to the inner wall of the drum so that the most advantageous pick-up and discharge position of each scoop can be selected for each combination of materials being dried. Toward this end, a series of holes 64 A–F (FIG. 6) is formed in each mounting plate 37 at a predetermined radius R from the axis of the hole 42 (FIG. 6), the radius being chosen to be equal to the distance D that the hole 49 of the adjacent end wall 45 is from the axis of connector 52. The number of holes in each mounting plate and their angular distance apart may vary according to the amount of adjustment required for a particular installation, as long as the holes in the two mounting plates that cooperate to mount a scoop have holes that conform in their size and location.

In the present embodiment, 6 holes are formed in each mounting plate 39 and the angle X between the holes is 15°. The hole 64A closest to edge 40 is located at an angle Y of 12° from a vertical plane P that is normal to the plane containing the radius on which the surface 40 was formed. These mounting plates 39 were designed for use with a scoop having walls 43 and 44 which are each 9 inches in length. The distance D and the radius R are each 7 inches.

It will be evident from FIG. 2 that a particular angular position of any scoop is obtained by loosening the bolts 62 to permit pivoting the scoop, pivoting the scoop until the holes 49 in the end plate are aligned with the selected holes 64 A–F in the mounting plates, and inserting bolts 66 in the aligned pairs of holes. Then a nut 67 is threaded tightly on each bolt 66, and the bolts 62 are again tightened in the connectors 52.

For any particular mixture of ingredients the time that the material will start to leave a bucket during the upward movement ot the bucket depends upon the angular position of the plane of the lower wall 44 of the scoop relative to a horizontal plane. For sand and crushed stone that angle is approximately 27°, and in FIGS. 8–13 there is diagrammatically shown the various angles at which dumping will start for each of the six different positions that are available when the scoop is mounted between two mounting plates having 6 holes such as holes 64A–64F, FIGS. 8–13 being oriented as if looking into the end where the chute 18 moves material into the drum. It will be understood that in FIGS. 8–13 and in the chart of FIG. 14, position A corresponds to a position wherein holes 64A have been selected. Similarly, position B corresponds to the hole 64B setting, and so forth for the positions C–F and holes 64 C–F respectively. As an example of one setting, FIG. 4 illustrates the position C setting of the scoop.

Referring to FIG. 8 it will be apparent that, when a mixture of sand and crushed stone is picked up by a scoop, it will start to be discharged when the scoop has been moved through 265° of clockwise rotation in the drum. The material will start to drop down in curtain-form through the flames and/or hot gases passing longitudinally through the drum. The scoop will be completely empty when the lower wall has reached a vertical position at 15° past top center. In position B the curtain will start to form at 280° of rotation and will terminate at 30° past top center. In position C the curtain will start to form at 295° of rotation and terminate at 45° past top center. Reference to FIG. 14 will disclose the starting and termination position for positions D,E, and F. In each instance, dumping takes place during 110° of rotation.

From the foregoing, it is evident that once the flow characteristics of a particular mixture of material is known, a position of the scoops can be selected to cause the curtain of discharging material to drop down through any desired section of the drum. For example, in position A the curtain will occupy the left side of the drum (as viewed in FIG. 8) and be contacted by hot gases moving along that side. In position F (FIG. 13) the curtain will drop down the right side of the drum. In positions C and D, the discharge will be more less centrally of the drum.

Referring to FIG. 1 it will be noted that the buckets 14, of which the scoops are a part, are positioned in rows spaced longitudinally of the drum. While 6 rows have been shown, this number is an arbitrary number, selected only for illustration purposes, it being understood that the number of rows can vary for different machines and installations. It will be evident that the scoops of all rows could be fixed in the same position, as for example, position D and then, if stone and gravel are being dried, the curtain will discharge substantially centrally of the drum as indicated in FIG. 11. In this case, the volume, intensity and current flow of the hot gases in the drum will have to be great enough to penetrate the curtain for the entire length of the drum in order to have an effective drying action on the curtain near the entrance end of the drum. Thus the drum has to be long enough, the drying gases have to be penetrating enough, and the speed of rotation has to be slow, enough for the gases to do the job.

If the scoops of the several rows, or some of them, are set at different positions than those in other rows, a different utilization of the hot gases can be obtained. For example, if the scoops of the first two rows, considered from the entrance end of the drum, were set at position A, the scoops of the second two rows set at position C and the scoops of the third two rows set at position F, the curtain of falling material would appear to move from left to right. With this arrangement, the hot gases passing along the right and left side of the drum, as well as those moving along the central zone are effectively used.

For some mixtures of materials, for most effective drying it is desirable to have the material discharged from the buckets so that it will slide down the inner wall of the drum. It will be seen in FIGS. 8–10 that, at the beginning of the discharge from the scoops in either of these positions the material will drop on an upwardly moving portion of the inner wall of the drum and will have to slide down along this wall to reach a pickup position at the extreme lower central area of the drum.

From the foregoing description it will be evident that the present invention provides a drier in which the orientation of the material elevating and discharging scoops can be changed to adapt the drier to the particular flow characteristics of the mixture of material being dried. While a few examples of specific settings have been illustrated, it will be recognized that a great number of other arrangements in the adjusted positions of the scoops may be made. Also, it is to be understood that, while mounting plates having six possible adjustments at 15° intervals have been shown, it is within the teaching of the present invention to provide other arrangements of holes in mounting plates.

I claim:

1. In a drier having a rotatable drum with a plurality of lifters mounted on the interior wall of the drum, the improvement which comprises means mounting each lifter on the wall including connector means on the wall and on the lifter, the connector means on the lifter being movable relative to the connector means on said wall to define a plurality of alternate positions of the lifter on the wall, said positions being arranged to provide for the effective discharge of different types of material from the lifter.

2. In a rotatable drier drum having a plurality of lifter blades mounted on the interior wall of the drum and extending inwardly therefrom, each blade being arranged to pick up material during rotation of the drum when the blade passes through a low portion of the orbit of rotation of the drum and discharge the material at a higher portion of the orbit, the improvement which comprises adjustable mounting means on said drum, and on each blade to vary the point in the orbit at which material is discharged by the lifter blades and including selectively positionable securement areas arranged for relative movement and adapted to be locked together to provide selective discharge points for different materials.

3. In a drier drum rotatable about a generally horizontal axis and having a plurality of lifters mounted on the interior wall of the drum, each lifter having a material support surface for picking up material accumulated in a low portion of the drum, raising it and discharging it at an elevated discharge position, the improvement which comprises means mounting each lifter on the wall of the drum including coacting means on said drum and on each lifter mounted for relative movement to provide a plurality of different angular settings of the lifter in the drum, said settings providing discharge positions for a variety of different materials.

4. A lifter for mounting on the interior wall of a cylindrical drier drum comprising bracket means fixedly secured to the wall and projecting inwardly therefrom, a material engaging and lifting member, and positioning means for selectively securing said member to said bracket means in any one of a plurality of fixed positions, said positioning means including coacting means on said bracket means and on said lifting member arranged for relative movement providing a plurality of different angular settings of the member relative to the drum, said settings providing discharge positions for a variety of different materials.

5. A lifter for mounting on the interior wall of a cylindrical drier drum comprising bracket means fixedly secured to the wall and projecting inwardly therefrom, a material engaging and lifting member, and means for selectively securing said member to said bracket means in any one of a plurality of fixed positions , said bracket means including a pair of plates mounted in spaced relation on said wall to project inwardly thereof, and said lifting member comprising a central scoop member and two end plates secured to said scoop at opposite ends thereof.

6. A lifter according to claim 5 wherein said securing means includes means defining a hole in each end plate and means defining a plurality of spaced holes in each of said mounting plates, the holes in one mounting plate being arranged in a pattern that is identical to the pattern of the holes in the other mounting plate.

7. A lifter according to claim 6 wherein said securing means also includes a fastening member extending through a hole in one end plate and a hole in an adjacent mounting plate and a second fastening member extending through the hole in the other end plate and a hole in the other mounting plate that corresponds to the hole in said adjacent mounting plate.

8. A lifter for mounting on the interior wall of a cylindrical drier drum comprising bracket means fixedly secured to the wall and projecting inwardly therefrom, a material engaging and lifting member, means for selectively securing said member to said bracket means in any one of a plurality of positions, said bracket means including a pair of mounting members secured in spaced relation on said wall to project inwardly therefrom, and said lifting member comprising a scoop.

* * * * *